US010052838B2

(12) United States Patent
Pettersson

(10) Patent No.: US 10,052,838 B2
(45) Date of Patent: Aug. 21, 2018

(54) CONVERTING MACHINE WITH AN UPWARD OUTFEED GUIDE

(71) Applicant: PACKSIZE LLC, Salt Lake City, UT (US)

(72) Inventor: Niklas Pettersson, Vasteras (SE)

(73) Assignee: Packsize LLC, Salt Lake City, UT (US)

( * ) Notice: Subject to any disclaimer, the term of this patent is extended or adjusted under 35 U.S.C. 154(b) by 610 days.

(21) Appl. No.: 14/370,729

(22) PCT Filed: Dec. 19, 2012

(86) PCT No.: PCT/US2012/070719

§ 371 (c)(1),
(2) Date: Jul. 3, 2014

(87) PCT Pub. No.: WO2013/106180

PCT Pub. Date: Jul. 18, 2013

(65) Prior Publication Data

US 2014/0336026 A1 Nov. 13, 2014

Related U.S. Application Data

(60) Provisional application No. 61/584,562, filed on Jan. 9, 2012, provisional application No. 61/587,005, filed on Jan. 16, 2012.

(51) Int. Cl.
*B31B 1/10* (2006.01)
*B31B 50/00* (2017.01)
(Continued)

(52) U.S. Cl.
CPC ..... *B31B 1/10* (2013.01); *B31B 50/00* (2017.08); *B31B 50/006* (2017.08); *B31B 50/10* (2017.08);
(Continued)

(58) Field of Classification Search
CPC ..... B31B 1/10; B31B 2201/0205; B31B 2201/14; B31B 2201/25; B31B 2201/26;
(Continued)

(56) References Cited

U.S. PATENT DOCUMENTS 2,077,428 A * 4/1937 Mabon ..... B41J 15/14 400/613.2
2,181,117 A 11/1939 Brenn
(Continued)

FOREIGN PATENT DOCUMENTS

CN 2164350 5/1994
CN 1191833 9/1998
(Continued)

OTHER PUBLICATIONS

U.S. Appl. No. 14/357,183, Jul. 16, 2015, Office Action.
(Continued)

*Primary Examiner* — Michelle Lopez
*Assistant Examiner* — Lucas Palmer
(74) *Attorney, Agent, or Firm* — Workman Nydegger

(57) ABSTRACT

A system that converts fanfold material into packaging templates includes a converting machine and a fanfold bale. The converting machine has a converting assembly that performs conversion functions, such as cutting, creasing, and scoring, on the fanfold material as the fanfold material moves through the converting machine in a first direction, to convert the fanfold material into one or more packaging templates. An outfeed guide changes the direction of movement of the packaging templates from the first direction to a second generally upwardly oriented direction after the packaging templates exit the converting machine.

25 Claims, 4 Drawing Sheets

(51) Int. Cl.
*B31B 50/10* (2017.01)
*B31B 50/14* (2017.01)
*B31B 50/25* (2017.01)
*B31B 50/26* (2017.01)
*B31B 50/98* (2017.01)

(52) U.S. Cl.
CPC ..... *B31B 50/14* (2017.08); *B31B 50/25* (2017.08); *B31B 50/26* (2017.08); *B31B 50/98* (2017.08); *B65B 2210/04* (2013.01)

(58) Field of Classification Search
CPC ..... B31B 2201/927; B31B 2201/95; B65B 2210/04
USPC ..... 493/52
See application file for complete search history.

(56) References Cited

U.S. PATENT DOCUMENTS 2,256,082 A 9/1941 Feurt
2,449,663 A * 9/1948 Marcalus ..... B65H 45/20 270/39.07
2,631,509 A * 3/1953 Whytlaw ..... B29C 53/48 156/203
2,679,195 A * 5/1954 Whytlaw ..... B31B 1/00 156/308.4
2,699,711 A * 1/1955 Mobley ..... B31B 1/00 493/123
2,798,582 A 7/1957 Monroe
3,096,692 A * 7/1963 Crathern, III ..... B31B 1/00 425/340
3,105,419 A 10/1963 La Bombard
3,108,515 A * 10/1963 Stohlquist ..... B31B 1/00 493/181
3,303,759 A 2/1967 Burke
3,418,893 A * 12/1968 Stohlquist ..... B31B 1/00 493/181
3,469,508 A * 9/1969 Klapp ..... B31B 1/00 493/164
3,511,496 A * 5/1970 Zoglmann ..... B65H 3/30 271/161
3,628,408 A 12/1971 Rod et al.
3,646,418 A 2/1972 Sterns et al.
3,743,154 A * 7/1973 Brewitz ..... B65H 23/28 226/113
3,803,798 A * 4/1974 Clancy ..... B65B 63/04 493/440
3,807,726 A * 4/1974 Hope ..... G03D 13/003 271/207
3,882,764 A 5/1975 Johnson
3,891,203 A * 6/1975 Schiff ..... B65C 9/02 271/198
3,912,389 A * 10/1975 Miyamoto ..... G03B 27/585 271/213
3,949,654 A 4/1976 Stehlin
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,173,106 A 11/1979 Garcia et al.
4,191,467 A * 3/1980 Schieck ..... G03G 15/60 312/60
4,224,847 A 9/1980 Tokuno
4,261,239 A 4/1981 Toboshi et al.
4,264,200 A 4/1981 Tickner
4,368,052 A 1/1983 Bitsky et al.
4,373,412 A 2/1983 Gerber et al.
4,375,970 A 3/1983 Murphy
4,487,596 A 12/1984 Livens et al.
4,563,169 A * 1/1986 Virta ..... B31B 1/00 493/126
D286,044 S * 10/1986 Kando ..... D18/12
4,638,696 A 1/1987 Urwyler
4,695,006 A 9/1987 Pool
4,714,946 A * 12/1987 Bajgert ..... B65H 5/26 355/75
4,743,131 A * 5/1988 Atwell ..... B41J 15/04 400/613.2
4,749,295 A * 6/1988 Bankier ..... B65H 45/1015 312/208.2
4,773,781 A * 9/1988 Bankier ..... B41J 11/58 400/613.2
4,838,468 A 6/1989 Lesse
4,847,632 A * 7/1989 Norris ..... B41J 29/026 346/134
4,923,188 A * 5/1990 Neir ..... B41J 11/58 270/39.01
4,979,932 A 12/1990 Burnside
5,005,816 A * 4/1991 Stemmler ..... B65H 45/24 198/534
5,039,242 A * 8/1991 Johnson ..... B41J 11/58 226/196.1
5,046,716 A * 9/1991 Lippold ..... G03B 42/045 271/163
5,058,872 A 10/1991 Gladow
5,072,641 A 12/1991 Urban et al.
5,081,487 A * 1/1992 Hoyer ..... B65H 31/02 271/213
5,090,281 A 2/1992 Paulson
5,111,252 A * 5/1992 Hamada ..... B65H 1/04 271/171
5,118,093 A * 6/1992 Makiura ..... G03G 15/234 271/213
5,123,890 A * 6/1992 Green, Jr. ..... B65H 33/00 270/21.1
5,123,894 A * 6/1992 Bergeman ..... B65H 45/1015 400/613.2
5,137,172 A * 8/1992 Wagner ..... B65B 25/08 221/26
5,137,174 A * 8/1992 Bell ..... G03G 15/60 271/161
5,197,366 A 3/1993 Paulson
5,240,243 A * 8/1993 Gompertz ..... B65H 29/26 271/186
5,241,353 A * 8/1993 Maeshima ..... G03G 15/6552 271/207
5,263,785 A * 11/1993 Negoro ..... B65H 23/02 400/613.2
D344,751 S * 3/1994 Keong ..... D18/49
5,321,464 A * 6/1994 Jessen ..... B65H 43/08 270/41
5,358,345 A * 10/1994 Damitio ..... B41J 11/58 400/613.2
5,369,939 A 12/1994 Moen et al.
5,375,390 A 12/1994 Frigo et al.
5,411,252 A * 5/1995 Lowell ..... B65H 5/36 271/223
5,584,633 A 12/1996 Scharer
5,586,758 A * 12/1996 Kimura ..... B65H 29/58 271/186
5,624,369 A 4/1997 Bidlack et al.
5,716,313 A * 2/1998 Sigrist ..... B31B 1/00 493/438
5,727,725 A * 3/1998 Paskvich ..... B65H 45/1015 206/494
5,836,498 A * 11/1998 Turek ..... B26F 3/002 225/1
5,902,223 A 5/1999 Simmons
5,927,702 A * 7/1999 Ishii ..... B65H 5/36 271/171
5,941,451 A 8/1999 Dexter
6,000,525 A * 12/1999 Frulio ..... B65B 35/243 198/400
6,189,933 B1 2/2001 Felderman
6,397,557 B1 6/2002 Bassissi
6,428,000 B1 * 8/2002 Hara ..... B65H 31/20 271/207
6,471,154 B1 10/2002 Zsolt

(56) References Cited

U.S. PATENT DOCUMENTS

| | | | | |
|---|---|---|---|---|
| 6,553,207 | B2 * | 4/2003 | Tsusaka | G03G 15/6552 399/401 |
| 6,568,865 | B1 * | 5/2003 | Fujioka | B65H 31/02 271/207 |
| 6,830,328 | B2 * | 12/2004 | Cuyler, Jr. | B41J 13/106 347/101 |
| 6,837,135 | B2 | 1/2005 | Michalski | |
| 6,840,898 | B2 | 1/2005 | Pettersson | |
| 6,968,859 | B1 | 11/2005 | Nagano et al. | |
| 7,100,811 | B2 | 9/2006 | Pettersson et al. | |
| 7,121,543 | B2 * | 10/2006 | Fujioka | B41J 11/0005 271/207 |
| 7,237,969 | B2 * | 7/2007 | Bartman | B41J 13/106 399/397 |
| 7,641,190 | B2 * | 1/2010 | Hara | B65H 1/00 271/145 |
| 7,647,752 | B2 | 1/2010 | Magnell | |
| 7,648,451 | B2 | 1/2010 | Calugi | |
| 7,997,578 | B2 * | 8/2011 | Saito | B65H 31/02 271/207 |
| D703,246 | S | 4/2014 | Pettersson et al. | |
| 2002/0017754 | A1 * | 2/2002 | Kang | B41J 11/0055 271/223 |
| 2002/0066683 | A1 | 6/2002 | Sanders | |
| 2002/0091050 | A1 * | 7/2002 | Bacciottini | B31F 1/10 493/86 |
| 2002/0115548 | A1 | 8/2002 | Lin et al. | |
| 2002/0125712 | A1 | 9/2002 | Felderman | |
| 2003/0102244 | A1 | 6/2003 | Sanders | |
| 2004/0060264 | A1 | 4/2004 | Miller | |
| 2004/0082453 | A1 | 4/2004 | Pettersson | |
| 2004/0092374 | A1 | 5/2004 | Chiu-Fu | |
| 2004/0261365 | A1 * | 12/2004 | White | B65B 25/14 53/429 |
| 2005/0103923 | A1 * | 5/2005 | Pettersson | B65H 20/00 242/615.2 |
| 2005/0215409 | A1 * | 9/2005 | Abramson | B31F 1/0009 493/476 |
| 2005/0280202 | A1 * | 12/2005 | Vila | B65H 31/02 271/213 |
| 2006/0180991 | A1 | 8/2006 | Nakahata et al. | |
| 2006/0181008 | A1 * | 8/2006 | Van Gerven | B62B 3/10 271/207 |
| 2007/0079575 | A1 | 4/2007 | Monti | |
| 2007/0289253 | A1 | 12/2007 | Miller | |
| 2008/0020916 | A1 | 1/2008 | Magnell | |
| 2008/0115641 | A1 | 5/2008 | Freyburger et al. | |
| 2008/0148917 | A1 | 6/2008 | Pettersson | |
| 2009/0178528 | A1 | 7/2009 | Adami | |
| 2009/0199527 | A1 | 8/2009 | Wehr et al. | |
| 2010/0041534 | A1 | 2/2010 | Harding | |
| 2010/0111584 | A1 * | 5/2010 | Shiohara | B41J 13/106 399/405 |
| 2011/0026999 | A1 | 2/2011 | Kohira | |
| 2011/0099782 | A1 | 5/2011 | Schonberger | |
| 2011/0110749 | A1 | 5/2011 | Carter et al. | |
| 2011/0171002 | A1 | 7/2011 | Pettersson | |
| 2011/0229191 | A1 | 9/2011 | Nomi | |
| 2011/0230325 | A1 | 9/2011 | Harding et al. | |
| 2011/0319242 | A1 | 12/2011 | Pettersson | |
| 2012/0129670 | A1 | 5/2012 | Pettersson et al. | |
| 2013/0045847 | A1 | 2/2013 | Capoia | |
| 2013/0210597 | A1 | 8/2013 | Pettersson | |
| 2013/0333538 | A1 * | 12/2013 | Long | B26D 7/06 83/102 |
| 2014/0315701 | A1 * | 10/2014 | Pettersson | B26D 1/18 493/56 |
| 2014/0336026 | A1 | 11/2014 | Pettersson | |
| 2015/0018189 | A1 | 1/2015 | Pettersson et al. | |
| 2015/0273897 | A1 * | 10/2015 | Kato | B41J 13/0009 347/104 |
| 2016/0001441 | A1 | 1/2016 | Osterhout et al. | |

FOREIGN PATENT DOCUMENTS

| | | | | |
|---|---|---|---|---|
| CN | 1366487 | | 8/2002 | |
| DE | 19541061 | | 11/1996 | |
| DE | 10355544 | | 6/2005 | |
| EP | 0030366 | | 6/1981 | |
| EP | 0359005 | | 3/1990 | |
| EP | 0650827 | | 5/1995 | |
| EP | 0889779 | | 1/1999 | |
| EP | 0903219 | | 3/1999 | |
| EP | 1497049 | | 3/2010 | |
| FR | 2721301 | | 12/1995 | |
| FR | 2808722 | | 11/2001 | |
| GB | 1362060 | | 7/1974 | |
| JP | S5557984 | | 4/1980 | |
| JP | S5689937 | | 7/1981 | |
| JP | 8238690 | | 9/1996 | |
| JP | 2000323324 | | 11/2000 | |
| JP | 2011520674 | | 7/2011 | |
| RU | 2015030 | | 6/1994 | |
| RU | 2004136918 | | 5/2006 | |
| RU | 2398674 | | 9/2010 | |
| SE | 450829 | | 8/1987 | |
| SU | 1054863 | | 11/1983 | |
| WO | 3089163 | | 10/2003 | |
| WO | 2010091043 | | 8/2010 | |
| WO | WO 2010091043 | A1 * | 8/2010 | B65H 16/00 |
| WO | 2011135433 | | 11/2011 | |
| WO | WO 2012003167 | A1 * | 1/2012 | B65H 23/28 |
| WO | 2013071073 | | 5/2013 | |
| WO | 2013071080 | | 5/2013 | |
| WO | 2013106180 | | 7/2013 | |

OTHER PUBLICATIONS

European Search Report for EP12848321 dated Jul. 1, 2015.
European Search Report for EP12865028 dated Jul. 7, 2015.
U.S. Appl. No. 14/357,183, Nov. 12, 2015, Final Office Action.
International Search Report and Written Opinion for PCT/US2012/064414 dated Jan. 25, 2013.
International Search Report and Written Opinion for PCT/US2012/064403 dated Apr. 8, 2013.
U.S. Appl. No. 29/419,922, Aug. 6, 2013, Office Action.
U.S. Appl. No. 29/419,922, Nov. 29, 2013, Notice of Allowance.
United States Search Authority, International Search Report and Written Opinion, Completed Feb. 8, 2013, dated Feb. 25, 2013.
U.S. Appl. No. 14/357,183, Jan. 29, 2016, Notice of Allowance.
U.S. Appl. No. 14/357,190, Feb. 17, 2017, Office Action.
European Search Report for EP16169030 dated Dec. 16, 2016, dated Jan. 5, 2017.
European Search Report for application No. EP17175751 dated Sep. 22 2017.
Japanese Office Action for application No. 2017-000038 dated Sep. 22, 2017.
U.S. Appl. No. 14/357,190, Aug. 1, 2017, Final Office Action.
U.S. Appl. No. 14/357,190, Jan. 12, 2018, Notice of Allowance.
U.S. Appl. No. 14/357,190, Dec. 1, 2017, Notice of Allowance.
International Search Report and Written Opinion for application No. PCT/US2017/036603 dated Oct. 27, 2017.
International Search Report and Written Opinion for application No. PCT/US2010/022983 dated Apr. 13, 2010.
International Search Report and Written Opininon for application No. PCT/US2017/036606 dated Oct. 24, 2017.
International Search Report for PCT/US2011/042096 dated Oct. 28, 2011.
European Search Report for EP10739040 dated Jan. 31, 2013.
European Search Report for EP80107577.1 dated Feb. 3, 1981.
European Search Report for EP89115688.7 dated Feb. 11, 1989.
U.S. Appl. No. 13/147,787, Aug. 27, 2014, Office Action.
U.S. Appl. No. 13/147,787, Apr. 17, 2015, Final Office Action.
U.S. Appl. No. 13/147,787, Sep. 30, 2015, Office Action.
U.S. Appl. No. 13/805,602, Dec. 2, 2015, Office Action.
U.S. Appl. No. 13/147,787, Feb. 16, 2016, Final Office Action.
U.S. Appl. No. 13/147,787, Oct. 28, 2016, Office Action.
U.S. Appl. No. 13/147,787, Mar. 7, 2017, Final Office Action.

(56) References Cited

OTHER PUBLICATIONS

U.S. Appl. No. 13/147,787, Jun. 26, 2017, Notice of Allowance.

* cited by examiner

CONVERTING MACHINE WITH AN UPWARD OUTFEED GUIDE

CROSS-REFERENCE TO RELATED APPLICATIONS

This application claims priority to and the benefit of PCT Application No. PCT/US2012/070719, filed Dec. 19, 2012, entitled "CONVERTING MACHINE WITH AN UPWARD OUTFEED GUIDE", which claims the benefit of and priority to the following applications: U.S. Provisional Application No. 61/587,005, filed Jan. 16, 2012, entitled "CONVERTING MACHINE WITH AN UPWARD OUTFEED GUIDE" and U.S. Provisional Application No. 61/584,562, filed Jan. 9, 2012, entitled "CONVERTING MACHINE WITH AN UPWARD OUTFEED GUIDE". All the aforementioned applications are incorporated by reference herein in their entirety.

BACKGROUND

1. Technical Field

Exemplary embodiments of the invention relate to systems, methods, and devices for converting sheet materials. More specifically, exemplary embodiments relate to a machine for converting paperboard, corrugated board, cardboard, and similar fanfold materials into templates for boxes and other packaging.

2. Background and Relevant Art

Shipping and packaging industries frequently use paperboard and other fanfold material processing equipment that converts fanfold materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 40% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Custom-sized boxes also reduce the shipping costs associated with shipping items compared to shipping the items in boxes. A shipping vehicle filled with boxes that are 40% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship that same number of items. Accordingly, in addition or as an alternative to calculating shipping prices based on the weight of a package, shipping prices are often affected by the size of the shipped package. Thus, reducing the size of an item's package can reduce the price of shipping the item.

Although sheet material processing machines and related equipment can potentially alleviate the inconveniences associated with stocking standard sized shipping supplies and reduce the amount of space required for storing such shipping supplies, the operation of previously available machines has required significant amounts of space to allow the sheet material to be fed into and out of the machine. The space required to operate these machines could be better used, for example, for storage of goods to be shipped. Accordingly, it would be advantageous to have a converting machine that requires less operating space.

BRIEF SUMMARY

This disclosure relates to systems, methods, and devices for processing paperboard (such as corrugated cardboard) and similar fanfold materials and converting the same into packaging templates. In one embodiment, for instance, a converting machine used to convert generally rigid fanfold material into a packaging template for assembly into boxes or other packaging includes a converting assembly and an outfeed guide. The converting assembly performs one or more conversion functions on the fanfold material as the fanfold material moves through the converting machine in a first direction, thereby forming the packaging template. The one or more conversion functions may be selected from a group consisting of creasing, bending, folding, perforating, cutting, and scoring, to create the packaging template. The outfeed guide changes the direction of movement of the packaging template from the first direction to a second generally upwardly oriented direction after the packaging template exits the converting assembly.

In another embodiment, a system for forming packaging templates for assembly into boxes or other packaging includes one or more stacks of fanfold material and a converting machine configured to convert the fanfold material into the packaging templates. Generally, the converting machine is positioned adjacent to the one or more stacks of fanfold material. The converting machine includes a converting assembly and one or more outfeed guides. The converting assembly can convert the fanfold material into the packaging templates. The converting assembly has one or more feed rollers and one or more converting tools. The one or more feed rollers move the fanfold material through the converting assembly in a first direction. As the fanfold material moves through the converting assembly, the one or more converting tools perform one or more conversion functions on the fanfold material in order to form the packaging templates. The one or more conversion functions may include creasing, bending, folding, perforating, cutting, and scoring. After the packaging templates exit the converting assembly, the one or more outfeed guides change the direction of movement of the packaging templates from the first direction to a second generally upwardly oriented direction.

In yet another embodiment, a method for creating packaging templates for assembly into boxes or other packaging from generally rigid fanfold material includes moving the fanfold material through a converting machine in a first direction. One or more conversion functions are performed on the fanfold material as the fanfold material moves through the converting machine in order to create the packaging template. The one or more conversion functions may include creasing, bending, folding, perforating, cutting, and scoring. The method also includes changing the direction of movement of the packaging template from the first direction to a second generally upwardly oriented direction after the packaging template exits the converting assembly.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
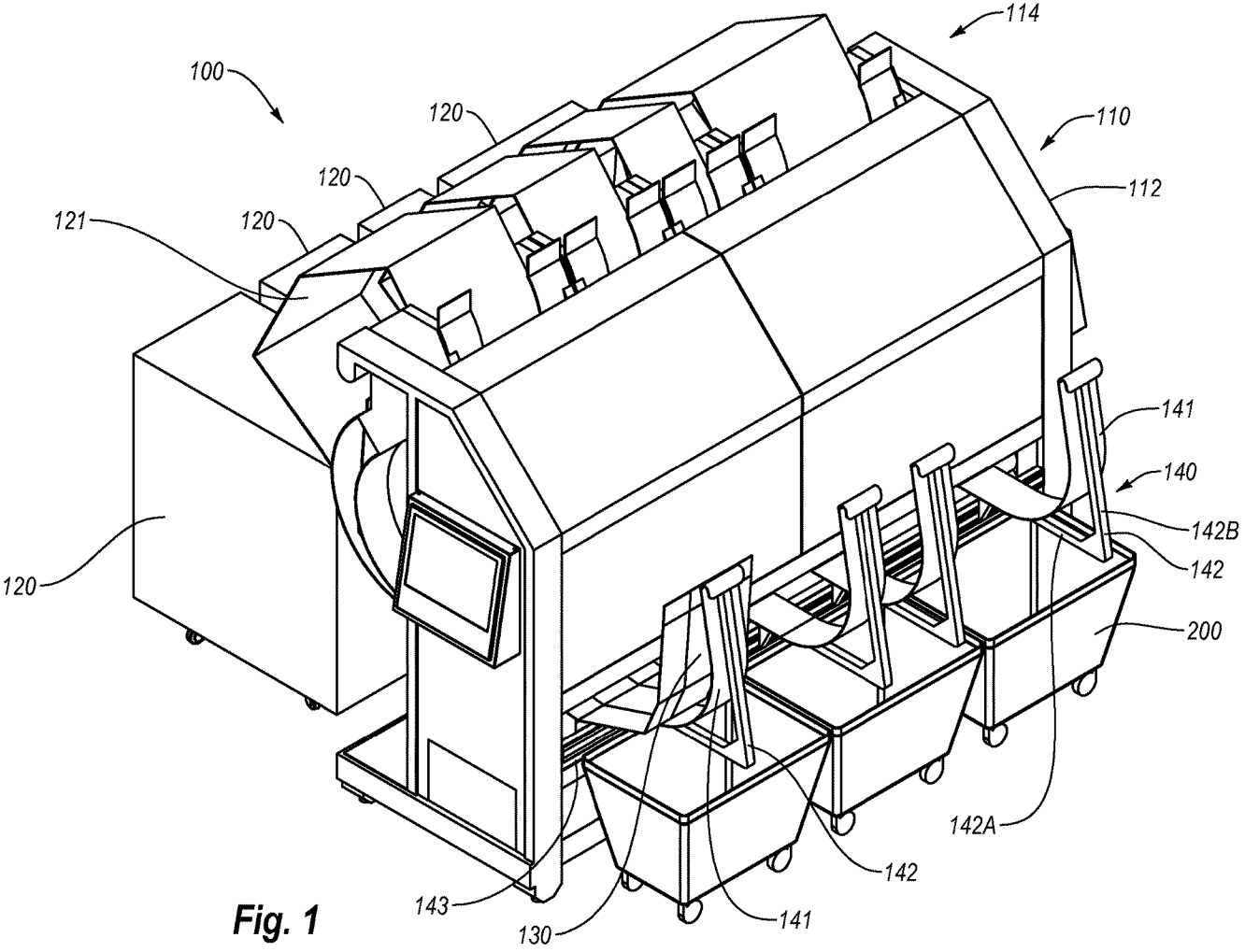
FIG. 1 illustrates a perspective view of a system for forming packaging templates as described in one aspect of this disclosure.

The embodiments described herein generally relate to systems, methods, and devices for processing paperboard and similar fanfold materials and converting the same into packaging templates. More specifically, the described embodiments relate to a converting machine with a direction-changing outfeed guide and methods for converting fanfold materials into packaging templates. Such direction changing outfeed guide can reduce the operational space required to convert the fanfold materials into packaging templates.

While the present disclosure will be described in detail with reference to specific configurations, the descriptions are illustrative and are not to be construed as limiting the scope of the present invention. Various modifications can be made to the illustrated configurations without departing from the spirit and scope of the invention as defined by the claims. For better understanding, like components have been designated by like reference numbers throughout the various accompanying figures.

As used herein, the term "bale" shall refer to a stock of sheet material that is generally rigid and may be used to make a packaging template. For example, the bale may be formed of a continuous sheet of material or a sheet of material of any specific length, such as corrugated cardboard and paperboard sheet materials, and includes stacks of fanfold material. Additionally, the bale may have stock material that is substantially flat, folded, or wound onto a bobbin.

As used herein, the term "packaging template" shall refer to a substantially flat stock of material that can be folded into a box-like shape. A packaging template may have notches, cutouts, divides, and/or creases that would allow the packaging template to be bent and/or folded into a box. Additionally, a packaging template may be made of any suitable material, generally known to those skilled in the art. For example, cardboard or corrugated paperboard may be used as the template material. A suitable material also may have any thickness and weight that would permit it to be bent and/or folded into a box-like shape.

As used herein, the term "crease" shall refer to a line along which the template may be folded. For example, a crease may be an indentation in the template material, which may aid in folding portions of the template separated by the crease, with respect to one another. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape created by removing material from the template or by separating portions of the template, such that a cut through the template is created.

As used herein, the term "support surface" shall refer to a surface that supports the machine described herein. Examples of support surfaces include but are not limited to a floor, ground, foundation, or stand.

As illustrated in FIG. 1, a system 100 for forming packaging templates can include a converting machine 110 and one or more fanfold bales 120. Generally, the converting machine 110 can receive fanfold material 121 from the one or more fanfold bales 120 to produce packaging templates 130. The packaging templates 130 can be used to form boxes or other packaging. Because the packaging templates 130 can be produced on demand and can have custom sizes, a shipper can produce boxes just in time for shipping, thereby avoiding the need to store standard-sized box templates.

Figure 3:
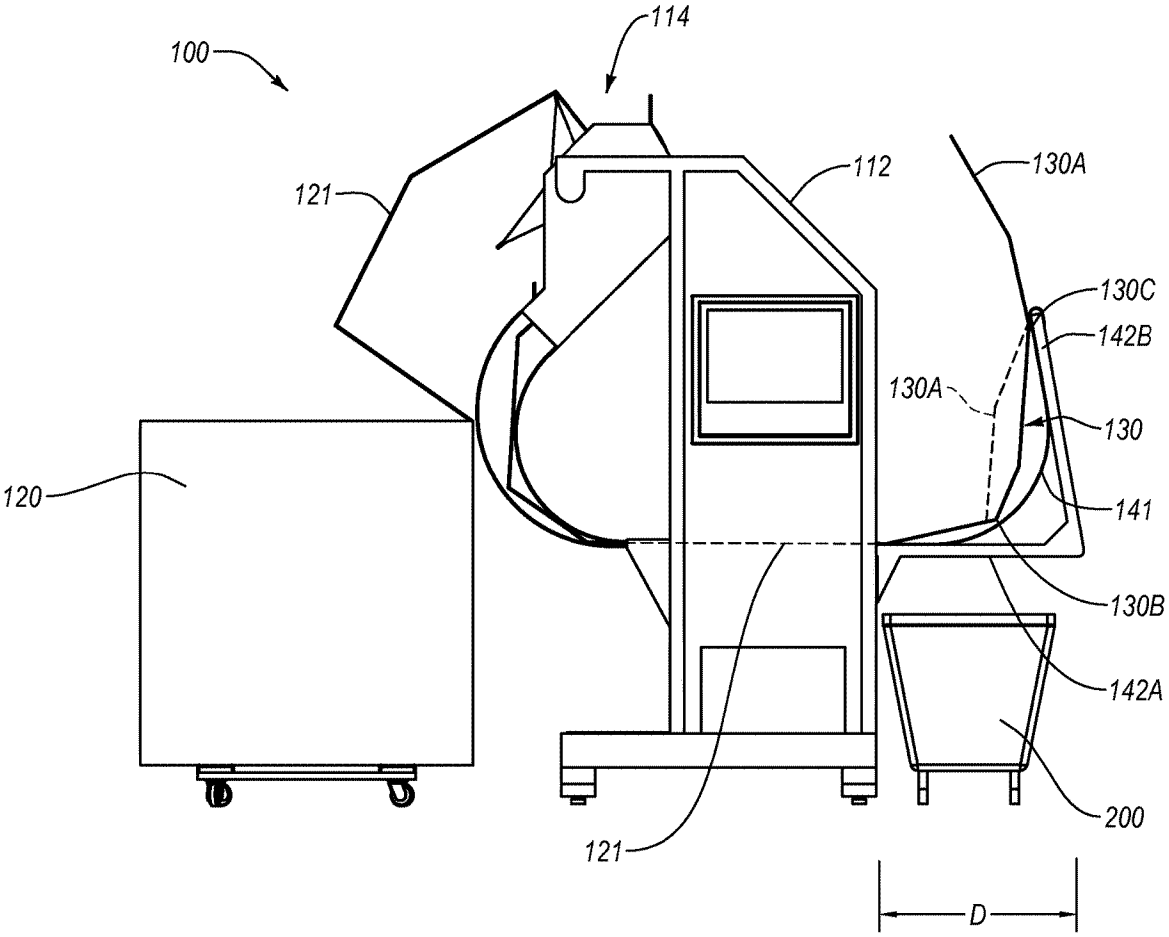
FIG. 3 illustrates a side view of the system of FIG. 1.
Figure 4:
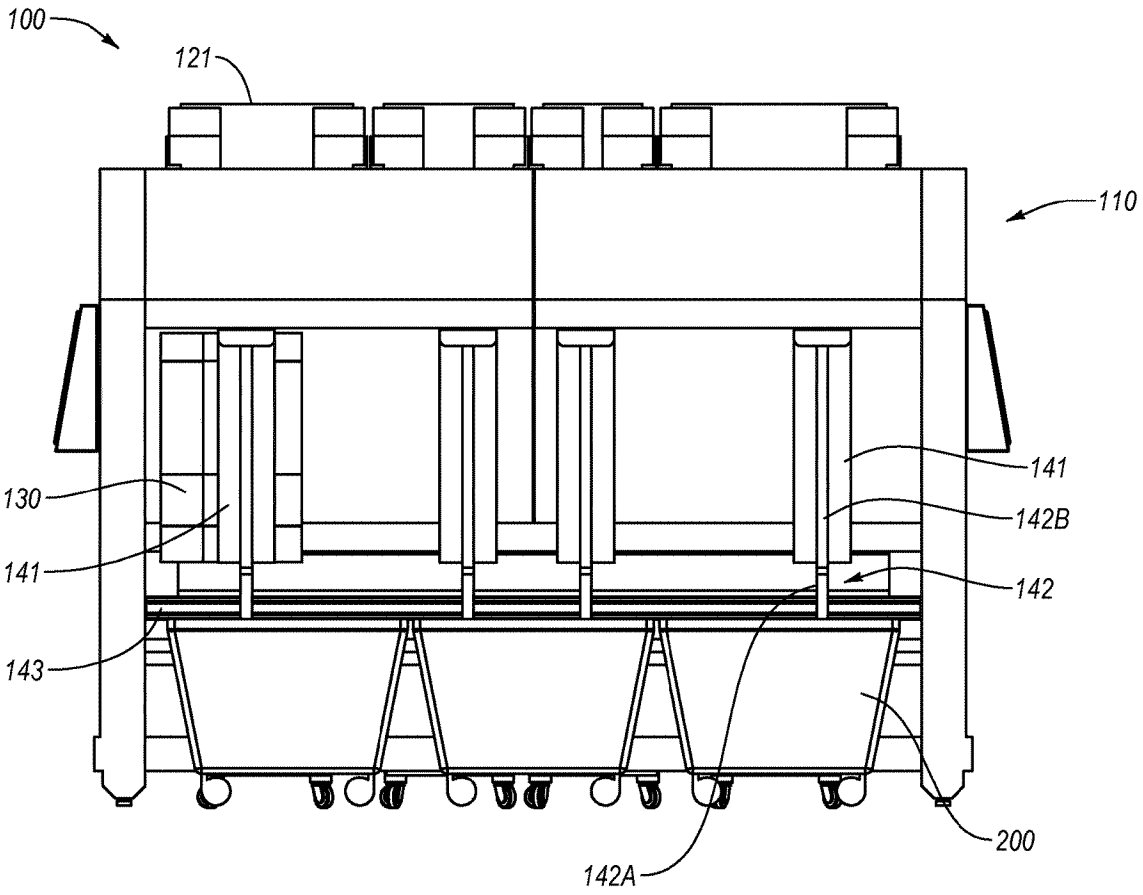
FIG. 4 illustrates a front view of the system of FIG. 1.

The one or more fanfold bales 120 may be disposed proximate to a bale side of the converting machine 110, and the fanfold material 121 may be fed into the converting machine 110 as shown in FIGS. 1 and 3, for example. The fanfold material 121 may be arranged in the one or more fanfold bales 120 as multiple stacked layers. The layers of the fanfold material 121 in each fanfold bale 120 may have generally equal lengths and widths and may be folded one on top of the other in alternating directions.

As shown in FIGS. 1 and 3, converting machine 110 can include an infeed system 114, a converting assembly 112, and an outfeed guide 140. The infeed system 114 can feed the fanfold material 121 into the converting assembly 112, which can perform various conversion functions on the fanfold material 121 to form a packaging template 130. After the conversion functions have been performed on the fanfold material 121 and the fanfold material 121 exits the converting assembly 112, the outfeed guide 140 can guide the packaging template 130 out of the converting assembly 112. Exemplary infeed systems and converting assemblies are disclosed in U.S. Pat. No. 7,100,811, issued Sep. 5, 2006, and entitled Web Guide and Method, and U.S. Pat. No. 6,840,898, issued Jan. 11, 2005, and entitled Apparatus for the Positioning of a Tool or a Tool Holder in a Machine Designed for Processing a Sheet Material, each of which is hereby incorporated herein by reference in its entirety.

Figure 2:
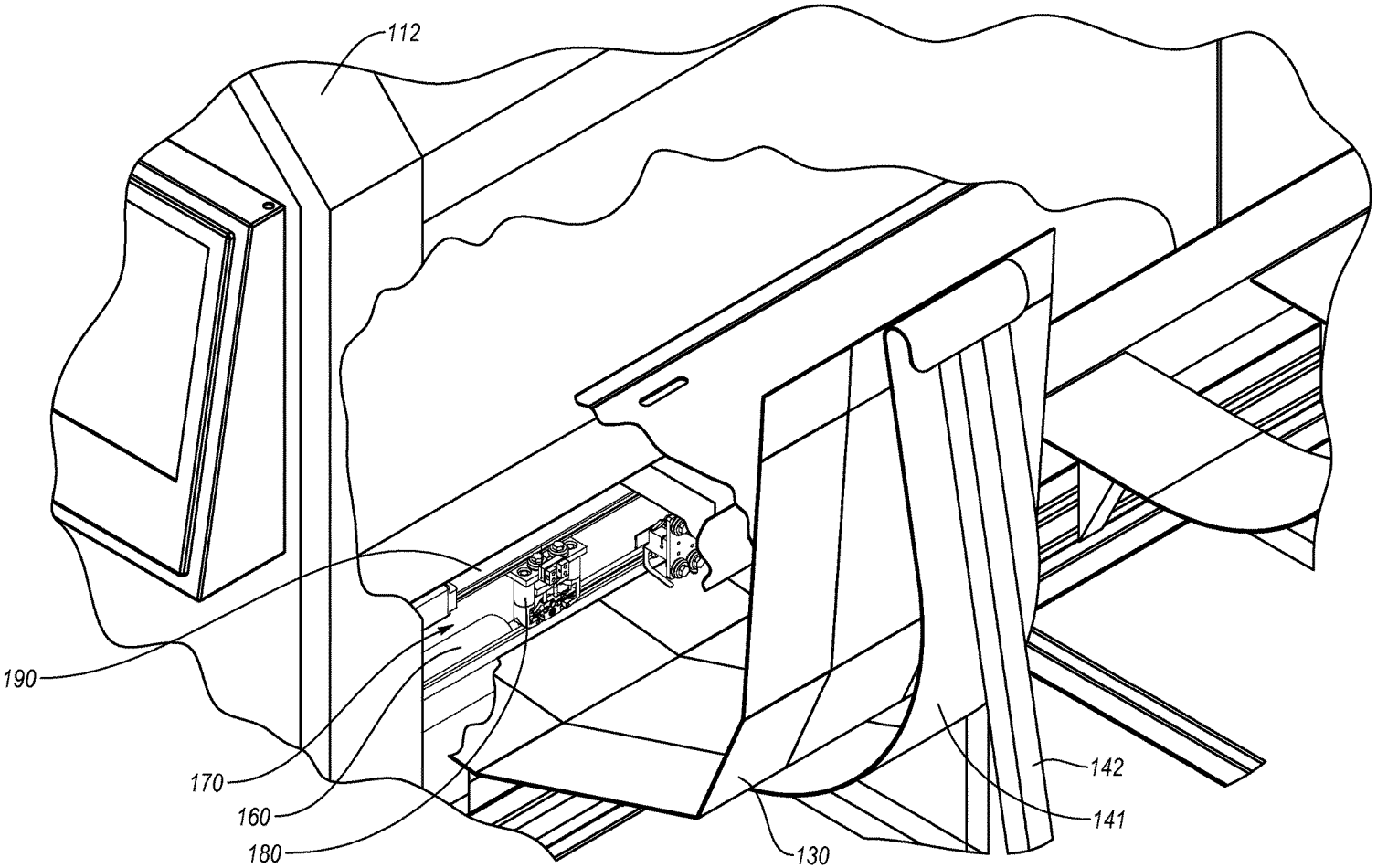
FIG. 2 illustrates a partial cutaway view of a portion of a converting machine of the system of FIG. 1.

Among other things, FIGS. 2 and 3 illustrate the movement of the fanfold material 121 through the converting assembly 112. As the fanfold material 121 moves through the converting assembly 112, various conversion functions can be performed by the converting assembly 112 on the fanfold material 121. After the conversion functions have been performed on the fanfold material 121, or a portion thereof, the resulting packaging template 130 can exit the converting assembly 112 on an operator side of the converting assembly 112. The outfeed guide 140 can guide the packaging template 130 as the packaging template 130 exits the converting assembly 112. It should be noted that the term "packaging template" refers to any portion of a packaging template, whether completed or unfinished. Accordingly, the term "packaging template" includes any portion of the fanfold material 121 that exits the converting assembly 112.

As described above, the converting machine 110 also can include a converting assembly 112, which can perform various conversion functions on the fanfold material 121 as the fanfold material 121 moves through the converting assembly 112. As shown in FIG. 2, the converting assembly 112 can include one or more feed rollers 160. The one or more feed rollers 160 may pull the fanfold material 121 into the converting assembly 112 and/or advance the fanfold material 121 therethrough. The feed rollers 160 may be configured to pull the fanfold material 121 with limited or no slip and may be smooth, textured, dimpled, and/or teethed.

The conversion functions performed by the converting assembly 112 to create the packaging templates 130 may include one or more of creasing, bending, folding, perforating, cutting, and/or scoring. The creases, bends, folds, perforations, cuts, and/or scores may be made on the fanfold material 121 in a direction substantially parallel to the direction of movement and/or length of the fanfold material 121. The creases, bends, folds, perforations, cuts, and/or scores also may be made on the fanfold material 121 in a direction substantially perpendicular to the direction of movement and/or length of the fanfold material 121.

Accordingly, as illustrated in FIG. 2, the converting assembly 112 may comprise a conversion mechanism 170 that is configured to crease, bend, fold, perforate, cut, and/or score the fanfold material 121 in order to create the packaging templates 130. The conversion mechanism 170 may include various tools 180 for making the creases, bends, folds, perforations, cuts, and/or scores in the fanfold material 121. U.S. Pat. No. 6,840,898, which is incorporated herein by reference in its entirety, describes exemplary converting mechanisms and converting tools that may be used in the converting assembly 112.

One or more of the tools 180, such as cutting and creasing wheels, may move within the converting assembly 112 in a direction generally perpendicular to the direction in which the fanfold material 121 is fed through the converting assembly 112 and/or the length of the fanfold material 121. For instance, one or more of the tools 180 may be disposed on a converting assembly cartridge 190. For example, the converting assembly cartridge 190 may have one or more longitudinal converting tools 180 which may perform one or more of above-described conversion functions on the fanfold material 121 in a longitudinal direction (e.g., in the direction of the movement of the fanfold material 121 and/or parallel to the length of the fanfold material 121) as the fanfold material 121 advances through the converting assembly 112.

The converting assembly cartridge 190 may move the one or more longitudinal converting tools 180 back and forth in a direction that is perpendicular to the length of the fanfold material 121 in order to properly position the one or more longitudinal converting tools 180 relative to the sides of the fanfold material 121. By way of example, if a longitudinal crease or cut needs to be made two inches from one edge of the fanfold material 121 (e.g., to trim excess material off of the edge of the fanfold material 121), the converting assembly cartridge 190 may move one of the longitudinal converting tools 180 perpendicularly across the fanfold material 121 to properly position the longitudinal converting tool 180 so as to be able to make the cut or crease at the desired location. In other words, the longitudinal converting tools 180 may be moved transversely across the fanfold material 121 to position the longitudinal converting tools 180 at the proper location to make the longitudinal conversions on the fanfold material 121.

The converting assembly cartridge 190 may also have one or more transverse converting tools 180, which may perform one or more of the above-described conversion functions on the fanfold material 121 in a transverse direction (e.g., in a direction substantially perpendicular to the longitudinal direction). More specifically, the converting assembly cartridge 190 may move the one or more transverse converting tools 180 back and forth in a direction that is perpendicular to the length of the fanfold material 121 in order to create transverse (e.g., perpendicularly oriented) creases, bends, folds, perforations, cuts, and/or scores in the fanfold material 121. In other words, the transverse converting tools 180 may be moved transversely across the fanfold material 121 in order to or while making the transverse conversions on the fanfold material 121.

According to some embodiments, the converting tools 180 may be selectively removable and/or replaceable. For instance, a worn or damaged tool 180 may be removed and repaired or replaced. Additionally, the tools 180 may be rearranged according to needs, such as when creating different packaging templates 130. For instance, creasing wheels may be replaced with cutting wheels, scoring tools 180 may be replaced with creasing wheels, etc. Moreover, in some implementations, the entire conversion mechanism 170 may be removable as a single unit, to be repaired or replaced with another suitable conversion mechanism 170.

As noted above, the converting assembly 112 may convert the fanfold material 121 into the packaging templates 130. The packaging templates 130 may be fed out of the converting assembly 112 toward the outfeed guide 140. The outfeed guide 140 may be configured to deflect and/or redirect the packaging templates 130 from moving in one direction to another.

As illustrated in FIGS. 2 and 3, in some embodiments, the outfeed guide 140 can redirect the packaging templates 130 from a substantially horizontal direction to a substantially upwardly oriented direction, by deflecting or redirecting the packaging templates 130. For example, as the packaging templates 130 move through and exit the converting assembly 112, the packaging templates 130 can be moving in a first or an original direction that can be substantially horizontal, and which may be substantially parallel to a support surface on which the converting machine 110 can be positioned. The outfeed guide 140 can deflect the packaging templates 130 such that, after the deflection, the packaging templates 130 move in a generally upwardly oriented direction (i.e., in a second or a deflected direction), away from the support surface.

At least a portion of the outfeed guide 140 can have an arcuate shape that can change the movement of the packaging templates 130 from the horizontal or first direction to the generally upwardly oriented direction. Accordingly, the packaging templates 130 can slide against the arcuate shape of the outfeed guide 140 and can be directed to move in the generally upwardly oriented direction. The arcuate shape can be made to accommodate the above-described reorientation without damaging or breaking the packaging templates 130.

Referring back to FIG. 1, in one or more embodiments, the outfeed guide 140 can include one or more tracks 141 and one or more frames 142. At least a portion of each track 141 can have a substantially arcuate shape. The tracks 141 and/or frames 142 can be secured directly to the converting assembly 112 or to a connector bar 143, which can be secured to the converting assembly 112. The one or more tracks 141 can be mounted on or secured to the one or more frames 142. For instance, the tracks 141 can be riveted, bolted, or welded to the frames 142. Additionally or alternatively, the tracks 141 can be folded or framed over or about the frames 142, such that the tracks 141 at least partially envelop the frames 142, thereby coupling to the frames 142.

One or more of the tracks 141 can be made from flexible and/or resilient material, such as sheet metal or plastic. Accordingly, the tracks 141 may be able to bend, flex, and/or deform at least slightly as the packaging templates 130 move thereagainst so as to prevent the packaging templates 130 from be damaged.

The frames 142 also can have or be formed by one or more supports. For example, the frames 142 can include supports 142A and 142B. Additionally or alternatively, the supports 142A, 142B can be secured one to another. For instance, the supports 142A, 142B can be welded, bolted, or riveted one to another.

In some implementation, the frames 142 also can include hinges or other movable connections. The hinges can allow one of the supports 142A, 142B to move with respect to another. For example, the supports 142A, 142B may be connected together by a hinge so that the support 142A can remain stationary while the support 142B can be selectively rotatable about the hinge. Accordingly, the support 142A can be oriented substantially in or parallel to the direction of the original movement of the fanfold material 121 (i.e., horizontally oriented) and the support 142B can be oriented generally in the direction of the deflected movement (e.g., generally upwardly). Moreover, the flexible and/or resilient material of the tracks 141 can facilitate the movement of the supports 142A and/or 142B by flexing, compressing, and/or deforming in response to such movement.

The supports 142A, 142B also can be formed or secured (e.g., by fastening one support to another or locking the hinges) in various relative positions. For instance, the supports 142A, 142B can be formed or selectively secured so as to form a 90° angle therebetween. Additionally, the supports 142A, 142B can be formed or selectively secured at other relative positions so as to form an angle of between about 45° and 180° therebetween. The angle between the supports 142A, 142B also can determine or affect the angle between the original and the deflected directions of movement of the fanfold material 12/packaging templates 130, as described above. Hence, in at least one embodiment, adjusting the angle between the supports 142A, 142B also can adjust the angle and/or the arcuate shape of the tracks 141. As a result of the various possible angles between the supports 142A, 142B, the direction of movement of the packaging templates 130 as they exit the converting assembly 112 may also vary from generally upwardly oriented directions to a generally horizontal direction.

In some implementations, the outfeed guide 140 can be configured so as to cause the packaging template 130 to fold as the packaging template 130 exits the converting assembly 112 and/or moves along a track 141. For instance, the outfeed guide 140 and/or the tracks 141 can change the direction of movement of the packaging template 130 such that a first part of the packaging template 130 overhangs a second part of the packaging template 130 that is separated from the first part by a crease (e.g., a fanfold crease or a crease formed by the converting assembly 112). Accordingly, the force of gravity can cause the first part of the packaging template 130 to fold along the crease and onto the second part of the packaging template 130.

For instance, as shown in FIG. 3, the fanfold material 121 moves through the converting assembly 112 in a generally horizontal plane. After exiting the converting assembly 112, the packaging template 130 formed from the fanfold material 121 engages the outfeed guide 140, which causes the packaging template 130 to move in a generally upwardly oriented direction. In the illustrated embodiment, the outfeed guide 140 is arranged (due to outfeed guide 140 being formed with an acute angle between supports 142A, 142B) to create an acute angle between the original horizontal direction of movement and the upwardly oriented direction of movement. As a result, a first end 130A of packaging template 130 overhangs a second end 130B of packaging template 130. Due to the force of gravity, the first end 130A folds along crease 130C and onto the second end 130B, as shown in dashed lines in FIG. 3.

Such overhang and, consequently, self-folding can be achieved by setting the angle between the original and deflected directions to be less than 90°. The self-folding also can be achieved at other angles, which can vary depending on the particular dimensions of the packaging template 130 and the location of the crease about which the packaging template 130 folds. As discussed above, the angle between the original and deflected directions can be established through the configuration or arrangement of the outfeed guide 140.

In addition to relying on the force of gravity to fold the packaging template 130 along a crease, the outfeed guide 140 can be configured to force-fold the packaging template 130. By way of example, the angle formed between supports 142A, 142B may be small enough so as to force the packaging template 130 to fold as the packaging template 130 moves therealong. This type of force-folding of the packaging template 130 may result in the creation of one or more additional creases being formed in the packaging template 130.

The outfeed guide 140 and/or any portion thereof can be removed and/or replaced with a different outfeed guide 140. For example, the outfeed guide 140 that provides a particular deflected direction of movement of the packaging templates 130 can be replaced with another outfeed guide 140, which provides a different deflected direction of movement of the packaging templates 130. Similarly, one or more of the tracks 141 can be removed and/or replaces with different tracks 141, which can provide different deflected directions of movement of the packaging templates 130 than the removed tracks 141.

As illustrated in the Figures, the tracks 141 can be configured to support the one or more packaging templates 130 during and/or after the packaging templates 130 exit the converting assembly 1112. For instance, the tracks 141 can be sufficiently wide such that the packaging templates 130 can lie on top of and can be supported by the tracks 141 until removed by the operator. In some embodiments, the tracks 141 also can be sufficiently narrow such that the scrap fanfold material 121 which was removed or cut from the fanfold material 121 to form the packaging template 130 can fall into a waste bin 200. Accordingly, the tracks 141 can have a width that is less than a width of the fanfold material 121.

As noted above, the converting machine 110 can accommodate one or more than one fanfold bales 120. More specifically, fanfold material 121 from a single fanfold bale 120 or from multiple side-by-side fanfold bales 120, as shown in FIG. 1, may be fed into converting assembly to form packaging templates 130. Depending on the number of fanfold bales 120 and their relative size and/or positioning, it may be desirable to reposition the tracks 141 of the outfeed guide 140 so that the tracks 141 are aligned with the packaging templates 130 as the packaging templates 130 exit the converting assembly 112. Accordingly, the outfeed guide 140 can be configured such that the tracks 141 can be selectively repositioned along the width of converting machine 110 and/or converting assembly 112.

Additionally, the tracks 141 and/or frames 142 can be positioned relative to one another along the width of the converting assembly 112 such that the packaging templates 130 can be readily removed therebetween. For instance, the tracks 141 and/or frames 142 can be positioned far enough apart from one another such that the packaging template 130 can be removed from the outfeed guide between the adjacent tracks 141 and/or frames 142.

Referring back to FIG. 3, in at least one implementation, the outfeed guide 140 can extend from the converting assembly 112 a relatively short distance D. For instance, the support 142A can extend a distance D from the converting assembly 112. By way of example, in some embodiments, distance D is equal to about 30 inches.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A converting machine used to convert generally rigid fanfold material into packaging templates for assembly into boxes or other packaging, the converting machine comprising:

a converting assembly configured to perform one or more conversion functions on said fanfold material as said fanfold material moves through said converting machine, such as to form said packaging template, the one or more conversion functions being selected from a group consisting of creasing, perforating, cutting, and scoring, to create said packaging template, the converting assembly being configured to advance the packaging template in a first direction out of the converting assembly; and an outfeed guide that changes the direction of movement of said packaging template from the first direction to a second generally upwardly oriented direction after said packaging template exits the converting assembly, the outfeed guide comprising:

a frame having a first support and a second support, the first support being oriented generally parallel to the first direction, the first support and the second support being connected together and forming an angle, the frame being positioned relative to the converting assembly such that the packaging template exits the converting assembly and advances into the angle formed by the first support member and the second support member; and a track connected to the frame, the track having a first end connected to a first end of the first support and a second end connected to a first end of the second support such that the portion of the track between the connections to the first support and the second support is disposed between the first support and the second support and substantially entirely within the angle formed by the first support and the second support and into which the packaging template advances.

2. The converting machine of claim 1, wherein at least a portion of the outfeed guide has a width that is less than a width of said fanfold material.

3. The converting machine of claim 1, wherein the outfeed guide is sized and configured to support said packaging template while said packaging template exits the converting assembly and until said packaging template is removed from the outfeed guide.

4. The converting machine of claim 1, wherein the outfeed guide is configured to cause said packaging template to fold as the outfeed guide changes the direction of said packaging template.

5. The converting machine of claim 4, wherein the outfeed guide is configured to cause said packaging template to fold along a crease formed by the one or more conversion functions.

6. The converting machine of claim 4, wherein the outfeed guide is configured to force-fold said packaging template as the outfeed guide changes the direction of said packaging template.

7. The converting machine of claim 1, wherein at least a portion of the track has a generally arcuate shaped surface that changes the direction of said fanfold material from the first direction to the second generally upwardly oriented direction as said fanfold material moves against the generally arcuate shaped surface.

8. The converting machine of claim 1, wherein the track comprises a flexible or resilient material.

9. The converting machine of claim 1, wherein the first direction is in a generally horizontal plane.

10. The converting machine of claim 1, wherein the second direction forms an angle with the first direction that is between about 45° and about 90°.

11. The converting machine of claim 1, wherein the outfeed guide is selectively adjustable such that the angle between the first support and the second support may be selectively adjusted.

12. The converting machine of claim 11, wherein the second support is selectively adjustable relative to the first support such that the first support and the second support are generally parallel to one another.

13. The converting machine of claim 12, wherein, when the second support is adjusted to be generally parallel to the first support, the outfeed guide enables said packaging template to continue moving in the first direction while said packaging template exits the converting assembly.

14. The converting machine of claim 1, wherein the outfeed guide may be selectively repositioned along a width of the converting machine.

15. The converting machine of claim 1, wherein the outfeed guide comprises a first outfeed guide, wherein the first outfeed guide may be selectively removed from said converting machine and replaced with a second outfeed guide having a different size or shape than the first outfeed guide.

16. The converting machine of claim 1, wherein the outfeed guide extends from the converting machine a distance of about 30 inches.

17. The converting machine of claim 1, wherein the outfeed guide comprises a plurality of tracks positioned along a width of the converting assembly.

18. The converting machine of claim 17, wherein one or more tracks of the plurality of tracks may be selectively repositioned along the width of the converting machine.

19. A system for forming packaging templates for assembly into boxes or other packaging, the system comprising:

one or more stacks of fanfold material;

a converting machine configured to convert the fanfold material into said packaging templates, the converting machine being positioned adjacent to the one or more stacks of fanfold material, the converting machine comprising:

a converting assembly configured to convert the fanfold material into a packaging template as the fanfold material moves through the converting assembly, wherein the converting assembly comprises one or more converting tools configured to perform one or more conversion functions on the fanfold material as the fanfold material moves through the converting assembly in order to form said packaging templates, the one or more conversion functions being selected from a group consisting of creasing, perforating, cutting, and scoring, the converting assembly being configured to advance the packaging template in a first direction out of the converting assembly; and a plurality of outfeed guides that change the direction of movement of the packaging template from the first direction to a second generally upwardly oriented direction after the packaging template exits the converting assembly, the plurality of outfeed guides comprising at least one outfeed guide comprising:

a frame having a first support and a second support, the first support being oriented generally parallel to the first direction, the first support and the second support being connected together and forming an angle, the frame being positioned relative to the converting assembly such that the packaging template exits the converting assembly and advances into the angle formed by the first support member and the second support member; and a track connected to the frame, the track having a first end connected to a first end of the first support and a second end connected to a first end of the second support such that the track is disposed between the first support and the second support and within the angle formed by the first support and the second support and into which the packaging template advances.

20. The system of claim 19, wherein the plurality of outfeed guides comprises a plurality of tracks.

21. The system of claim 20, wherein adjacent tracks of the plurality of tracks are spaced apart sufficiently to allow said packaging templates to be removed therebetween.

22. The system of claim 20, wherein one or more tracks of the plurality of tracks may be selectively repositioned along a width of the converting machine.

23. The system of claim 20, wherein each track of the plurality of tracks has a width that is less than a width of a corresponding stack of fanfold material, such that the tracks support said packaging templates while also allowing excess fanfold material that is removed by the converting assembly during the creation of said packaging templates to fall below the outfeed guide.

24. A method for creating packaging templates for assembly into boxes or other packaging from generally rigid fanfold material, the method comprising:

moving said fanfold material through a converting assembly;

performing one or more conversion functions on said fanfold material as said fanfold material moves through the converting assembly, the one or more conversion functions being selected from a group consisting of creasing, perforating, cutting, and scoring, to create said packaging template;

advancing the packaging template out of the converting assembly in a first direction; and changing the direction of movement of said packaging template from the first direction to a second generally upwardly oriented direction after said packaging template exits the converting assembly, wherein changing the direction of said packaging template from the first direction to the second generally upwardly oriented direction comprises moving said packaging template against an outfeed guide comprising:

a frame having a first support and a second support, the first support being oriented generally parallel to the first direction, the first support and the second support being connected together and forming an angle, the frame being positioned relative to the converting assembly such that the packaging template exits the converting assembly and advances into the angle formed by the first support member and the second support member; and a track connected to the frame, the track having a first end connected to a first end of the first support and a second end connected to a first end of the second support such that the track is disposed between the first support and the second support and within the angle formed by the first support and the second support and into which the packaging template advances.

25. The method of claim 24, wherein the track comprises a generally arcuate shaped surface.

* * * * *